US005295473A

United States Patent [19]

Neufeldt

[11] Patent Number: 5,295,473

[45] Date of Patent: Mar. 22, 1994

[54] FURNACE

[76] Inventor: Jacob J. Neufeldt, 1212 - 22nd Avenue, Coaldale, Alberta, Canada

[21] Appl. No.: 853,391

[22] Filed: Mar. 18, 1992

[51] Int. Cl.[5] ..... F24H 3/10

[52] U.S. Cl. ..... 126/103; 126/110 R; 126/116 R; 165/166

[58] Field of Search ..... 165/166; 126/110 R, 126/110 A, 103, 116

[56] References Cited

U.S. PATENT DOCUMENTS 1,873,570 8/1932 Frantz ..... 126/116 R
2,173,280 9/1939 Le Tourneau ..... 126/110 R
2,303,157 11/1942 Bush ..... 165/167

FOREIGN PATENT DOCUMENTS 460734 11/1949 Canada ..... 126/110 R
968367 11/1950 France ..... 126/110 R

*Primary Examiner*—Albert W. Davis, Jr.
*Attorney, Agent, or Firm*—Stevens, Davis, Miller & Mosher

[57] ABSTRACT

A heating furnace is provided with a counterflow heat exchanger defining serpentine up flow fresh air passages and downflow combustion products passages. The exchanger is of sheet metal modular construction.

4 Claims, 7 Drawing Sheets

FURNACE

BACKGROUND OF THE INVENTION

The present invention relates to a heating furnace particularly well suited for use in mines and the like.

There is a need in the underground mining industry for a compact, high capacity, efficient and safe heating furnace which can be transported readily and which can withstand rough usage.

OBJECTS AND SUMMARY OF INVENTION

Objects of the invention are to provide a furnace of the type noted above having both an improved overall layout including an improved heat exchanger:

(a) providing for high turbulence of the air flows resulting in good scrubbing of the heat transfer surfaces and high heat transfer rates;

(b) providing heat transfer surfaces less prone to heat warpage;

(c) which is compact relative to the heat transfer area provided;

(d) which has a 'modular' construction enabling the number of heat transfer units or modules to be easily increased or decreased to suit heating capacity requirements;

(e) which is designed so that condensation can readily drain away thus reducing corrosion and other problems;

(f) wherein all parts of the furnace are at least partly exposed to fresh cool air to avoid overheating of components thus prolonging their lives; and (g) which is cost-effective, efficient and durable.

BRIEF DESCRIPTION OF THE DRAWINGS

These and other features of the invention will become more apparent from the following description in which reference is made to the appended drawings wherein.

DESCRIPTION OF PREFERRED EMBODIMENT

Figure 1:
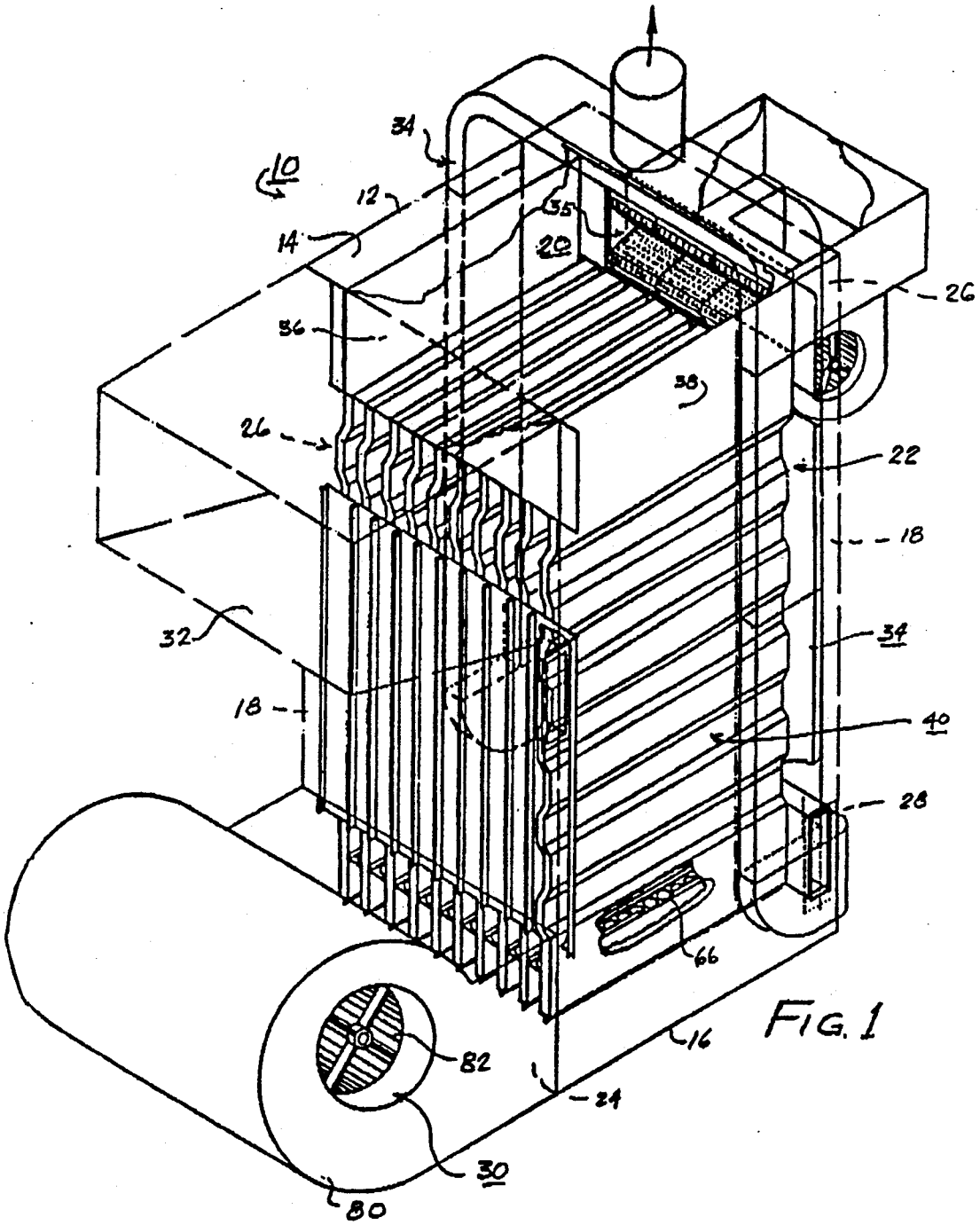
FIG. 1 is a perspective view of a furnace according to the preferred embodiment of the present invention and showing a fresh air intake assembly, a heated fresh air discharge duct, a combustion air intake and burner assembly, the furnace housing being partly in phantom to show the internal structure.
Figure 2:
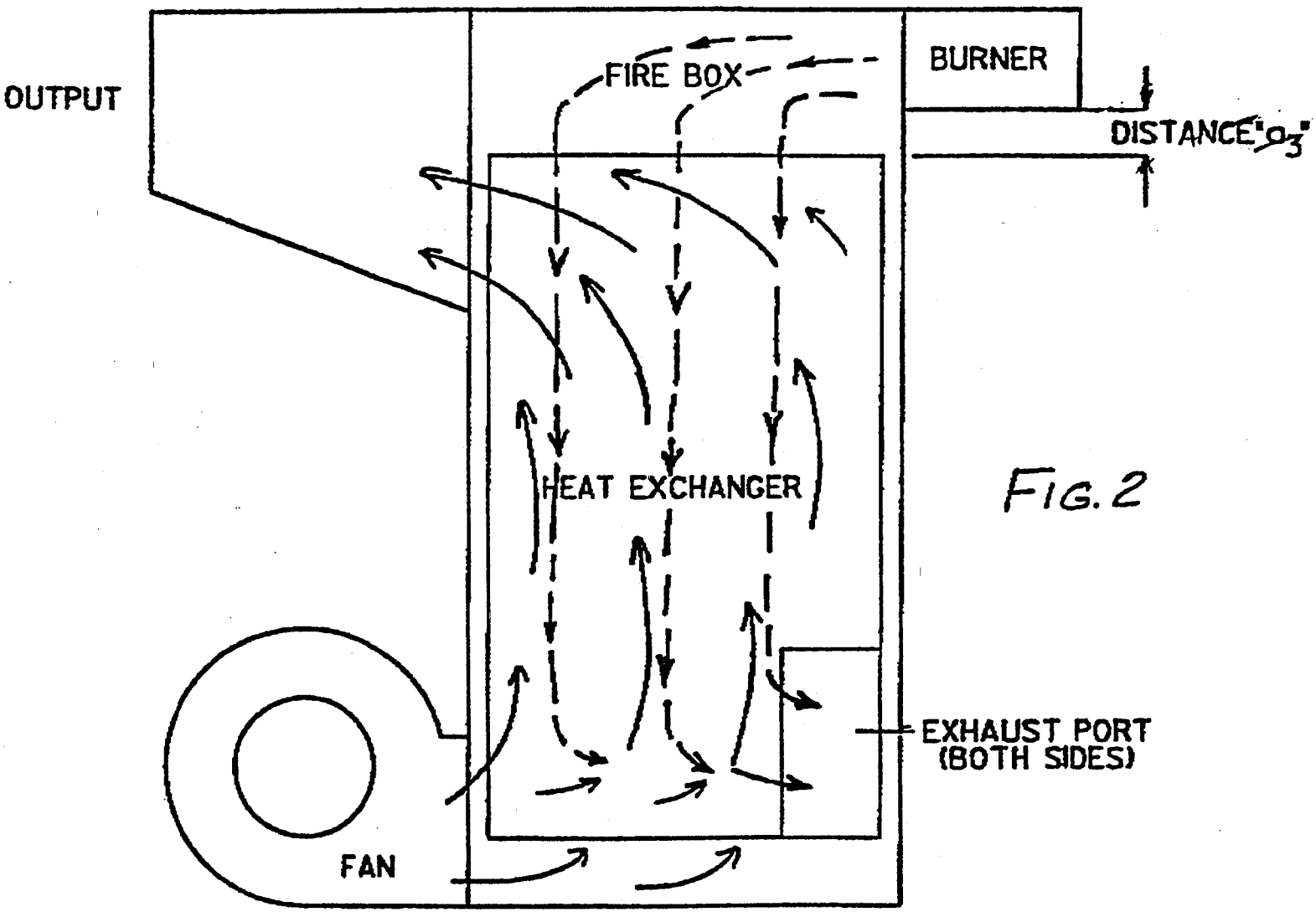
FIG. 2 is a diagrammatic side elevational view illustrating the fresh air flow path (full arrows) through the furnace and the combustion air paths (broken arrows)
Figure 7:
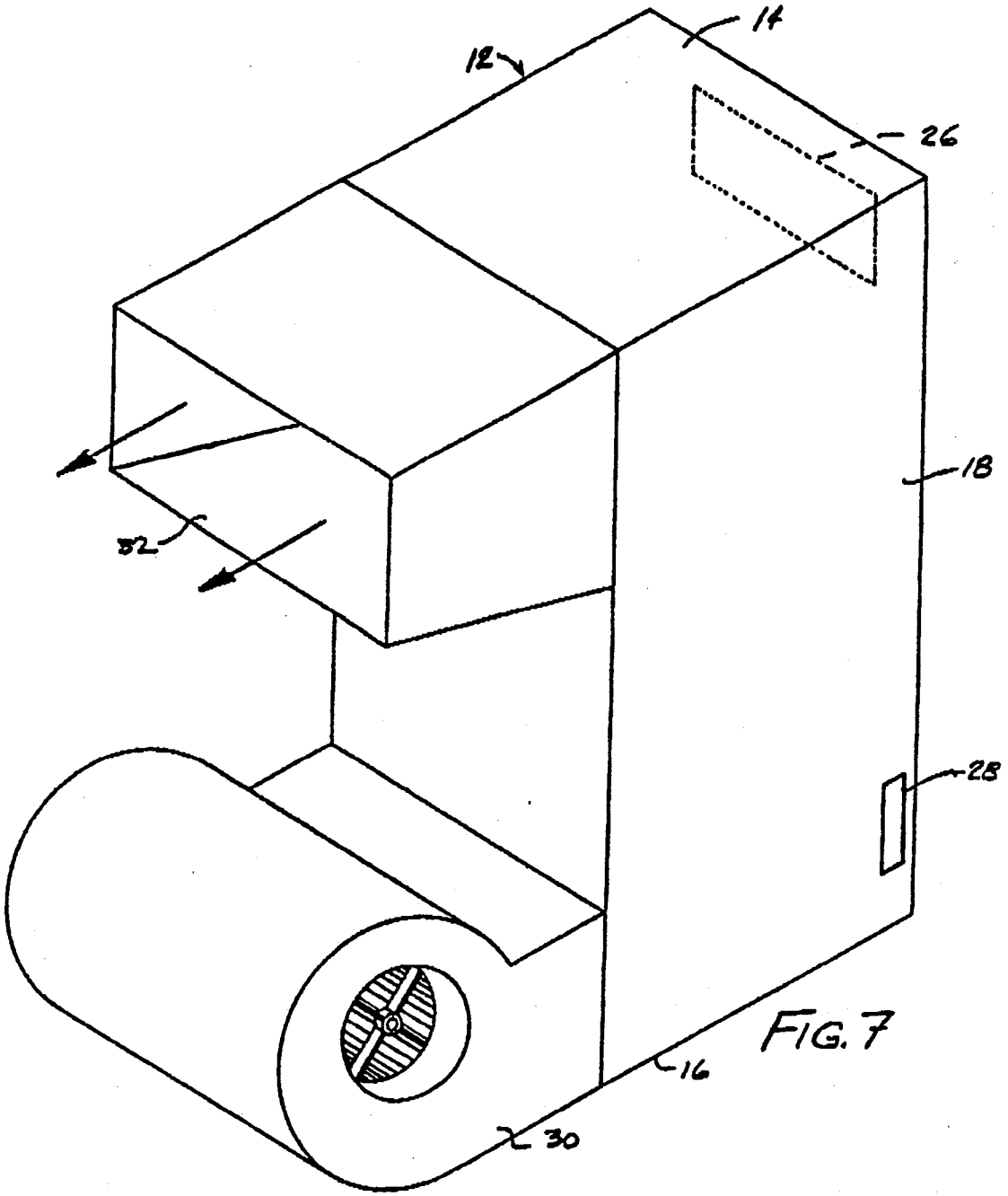
FIG. 7 is a perspective view of the furnace exterior housing (including the fresh air intake assembly).

The furnace 10 includes a generally rectangular housing 12 (FIGS. 1 & 7) having a top wall 14, a bottom wall 16 and four side walls 18. The walls are formed of stainless steel sheet metal and all connected together in edge-to-edge relation using conventional sheet metal techniques. The upper end of the housing includes a firebox chamber 20 which extends downwardly from the top wall between the four side walls, and a heat exchange chamber 22 which extends from the bottom end of the firebox chamber, within the four side walls 18, to the bottom wall 16. The housing 12 has several openings including a fresh air intake opening 24 in the frontal side wall adjacent the bottom, a heated fresh air discharge opening 26 in the frontal side wall below the firebox 20, a combustion air intake opening 27 in a rear side wall opposite the frontal side wall and adjacent the top wall and leading into the firebox, and two combustion product discharge openings 28 adjacent the bottom wall, one in each of the other two of the side walls 18.

Connected to the exterior of the housing are a fresh air intake fan assembly 30 which discharges into the fresh air intake opening 24, a heated fresh air discharge duct 32 which leads outwardly from the heated fresh air discharge opening 26, a burner assembly 35 which lies within the combustion air intake opening 27 and a generally inverted U-shaped combustion product discharge conduit 34 which communicates with the combustion product discharge openings 28. A heat exchanger is mounted in the heat exchange chamber.

Figure 3:
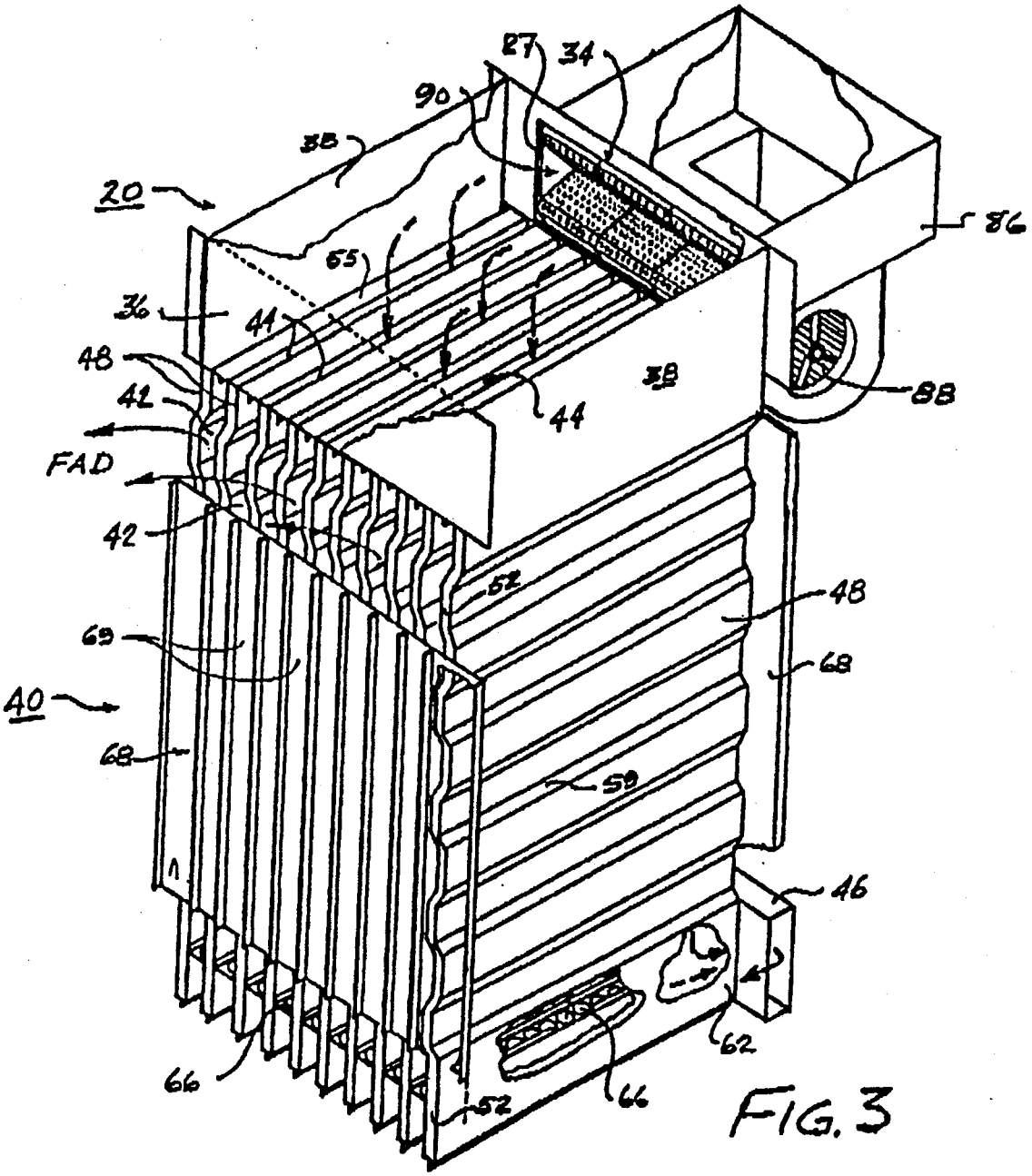
FIG. 3 is a perspective view of the heat exchanger, firebox, combustion air intake and burner assembly.

The firebox 20 (FIG. 3) is formed with a front wall 36, a rear wall 37 and a pair of side walls 38 spaced inwardly from the front wall and adjacent side walls 18 of the housing 12, and a top wall 38 spaced from the top wall of the housing 12. The two side walls 38 are formed with extensions which engage the insides of the housing side walls 18 and, thus, serve to locate the firebox 20 within the housing 12. The rear wall 37 of the firebox communicates with the combustion air intake opening 27. The bottom end of the firebox 20 is secured to the upper end of the heat exchanger and is open to the upper combustion air inlet end of the heat exchanger to be described hereafter.

The heat exchanger 40 (FIGS. 1 & 3) is a counterflow air-to-air heat exchanger having alternating fresh air passages 42 and combustion air flow passages 44. The fresh air passages 42 extend from the fresh air intake opening 24 to the heated fresh air discharge opening 26 so that this flow is upward through the heat exchanger 40. The combustion air passages 44 extend from the firebox chamber 20 to a combustion product collection manifold 46 which extends between and is connected to the combustion product discharge openings 28. Thus, the combustion air products flow downwardly through the heat exchanger via the passages 44. The fresh air passages 42 must handle higher air flow volumes than the combustion air flow passages 44 and hence passages 42 typically have cross-sectional flow areas several (e.g. 2 or 3) times greater than flow passages 44. This is provided by effecting suitable spacings between the sheet metal side walls making up the flue sections of the heat exchanger which will now be described.

Figure 4:
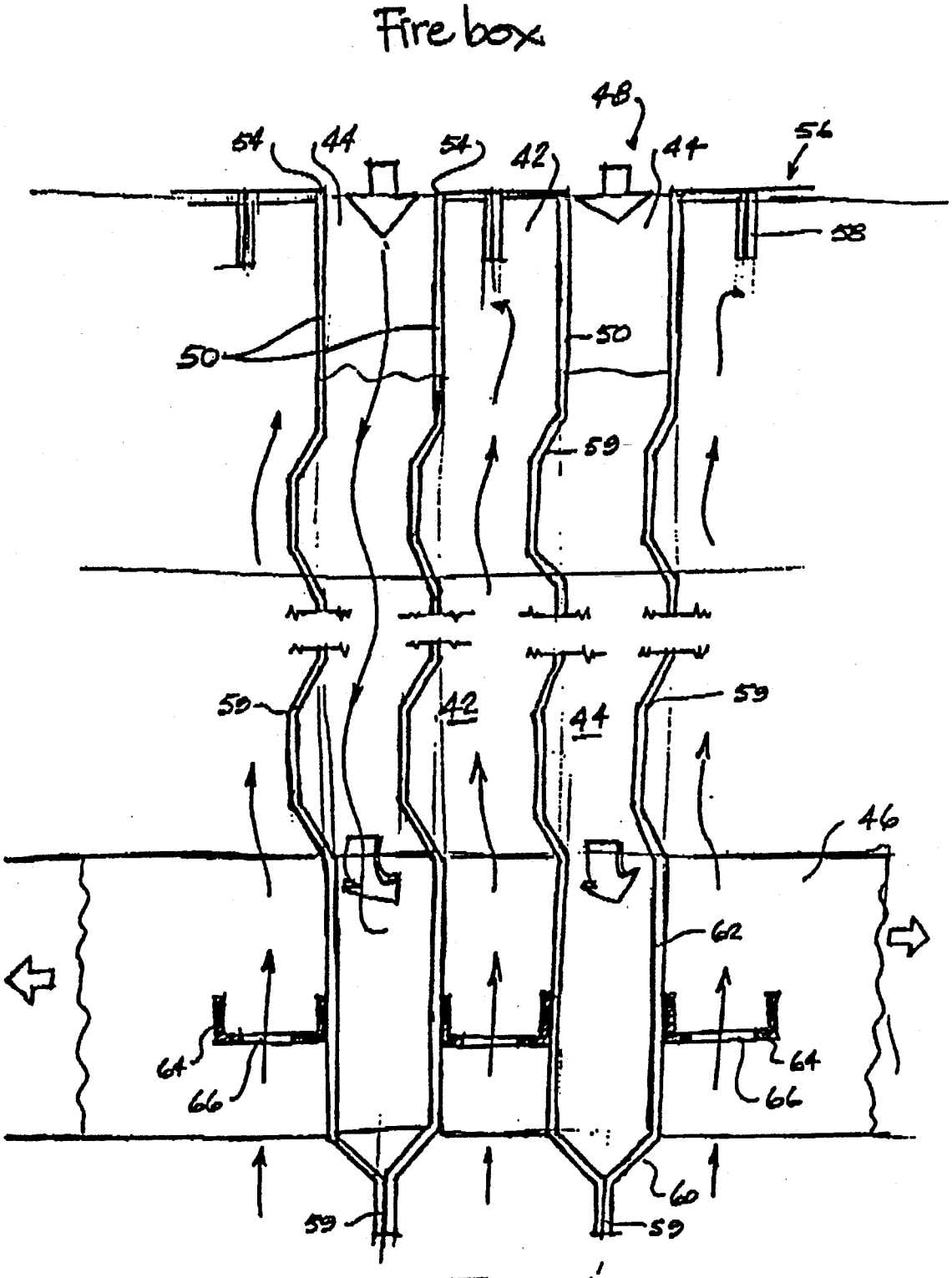
FIG. 4 is a partial vertical section view taken through the flue sections of the heat exchanger.
Figure 5:
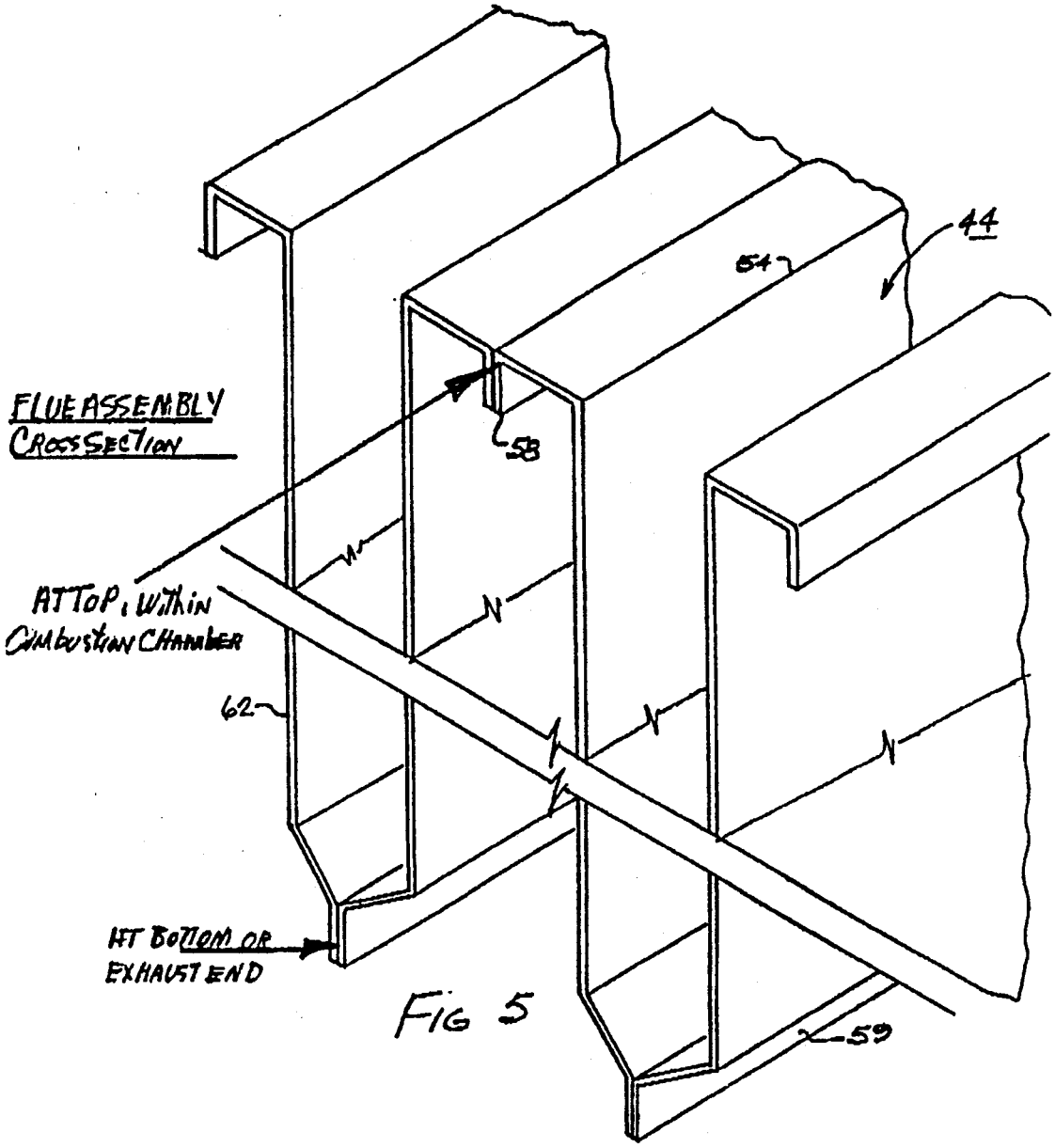
FIG. 5 is a partial perspective view of the flue sections which make up the heat exchanger.

The passages 42, 44 are defined by a plurality of generally rectangular flue sections 48 (FIGS. 4 & 5) formed of sheet metal (preferably stainless steel). Each flue section 48 includes a pair of spaced apart parallel side walls 50, opposed end walls 52 which are connected to the side walls 50, and a closed bottom end 60, all of which are connected together in sealed relation in suitable fashion, as by welds. A suitable high temperature sealing compound is typically used to seal any gaps in the joints between the sheet metal panels. The upper ends of the side walls 50 are bent outwardly along two transversely extending bend lines 54 to form a heat exchanger upper surface 55 and downturned abutting top flanges 58. The side walls 50 are formed with a plurality of angulated corrugations 59 which extend transversely of the gas flow direction to form generally serpentine shaped flow paths in both sets of passages 42 and 44. The bottom ends 60 of the flues 48 are formed to define generally box-shaped sections 62. A vertically extending, rectangular discharge opening 61 is defined at the back end of each box-shaped section 62. The discharge openings 61 at the back ends of the box-shaped sections at the lower ends of the flues 48 are each sealingly connected, as by welding, to the transversely extending combustion product exhaust manifold 46 located at the lower rear of the heat exchanger. Manifold 46 communicates with the combustion air exhaust ducting to be described hereafter. Any condensate forming during combustion readily drains downwardly away from the flue assemblies and escapes via suitable bottom drain openings. The corrugated flue side walls 50 tend to reduce the air flow rate and cause turbulent flow so as to increase the heat "scrubbing" capability of the flue walls. In addition, the corrugations strengthen the flue wall panels, inherently accommodate warpage caused by the large thermal gradients while at the same time increasing the heat exchange surface area of the exchanger per unit length.

The flues 48 are connected together along the upper and bottom ends. At the upper and lower ends, the flanges 58, 59 respectively are brought into abutting engagement and sealingly secured together such as by welding. The bottom ends 60 are secured together by elongated U-shaped channel members 64 which are formed with a plurality of equally spaced holes 66 for evenly admitting fresh air from the intake fan into the upflow air passages 42 between the flues 48. A spacer end sheet 68 is secured to each of the front and back ends of the heat exchanger 40 to both space the heat exchanger from the housing side walls 18 and close the spaces between the flues 48 so as to define end walls for the fresh air passages 42. The spacer end sheets 68 are formed from a series of shallow U-channels 69 connected edge-to-edge by bolts or welds thereby to facilitate assembly of the heat exchanger. The channels are each secured to the ends of the flue side walls via welds with high temperature furnace sealing compound used as necessary to seal the joints.

The flue construction having the flanges thus shown provides narrow parallel slot-like entrances for the combustion air at the top of the heat exchanger, with the combustion air, after travelling downwardly through the serpentine flow paths 44, exiting via the discharge openings 61 at the rear lower ends of the flue sections. The upwardly flowing fresh air passes through the serpentine flow paths 42, each of which is located between a pair of flow paths 44, with heated fresh air discharge (FAD) taking place at the upper frontal portion of the heat exchanger in the space between the upper edge of the end sheet 68 and the lower edge of the frontal wall 36 of the firebox. The rear face of the heat exchanger is closed off by the rear end sheet 68 to avoid escape of the heated fresh air at the rear of the heat exchanger. The flanged construction shown also closes off the upper ends of the fresh air paths 44, forcing this air to turn 90 degrees at the upper end of the travel paths and to exit as described above.

The modular nature of the flues 48 allows furnaces of different capacities to be manufactured very easily simply by adding or removing an appropriate number of flue sections. It will also be noted that all joints are located on the fresh air side of the flue sections so as to minimize thermal expansion thereof. In order to keep the housing side walls 18 reasonably cool a flow of incoming fresh air is allowed to travel upwardly along the exterior surfaces of the heat exchanger interiorly of the housing side walls 18.

Figure 6:
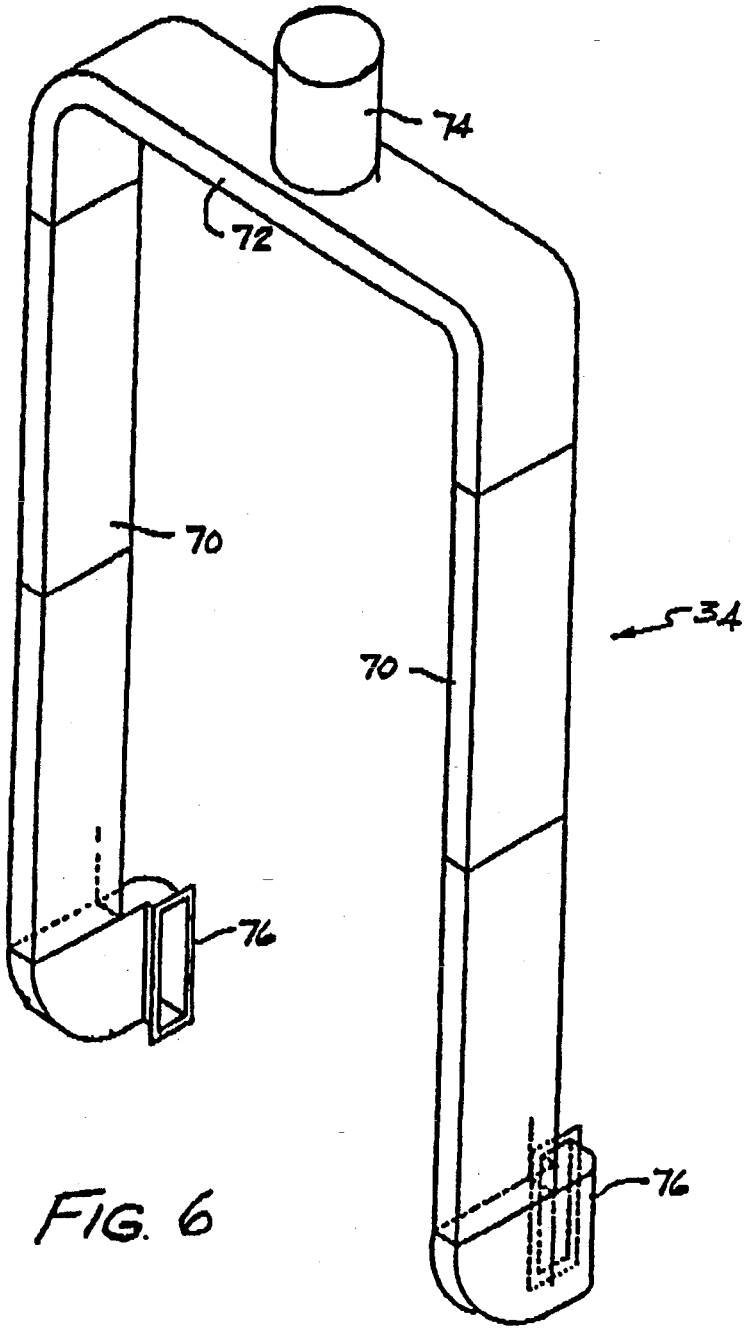
FIG. 6 is a perspective view of the exhaust duct.

The combustion air exhaust ducting 34 (FIG. 6) is generally of an inverted U-shape which straddles the furnace housing 12. The exhaust ducting includes a pair of vertically extending arms 70 and a horizontally extending duct section 72 connected to the upper ends of the arms. A cylindrical chimney 74 extends vertically from the mid-section of the horizontally extending duct section. The lower ends 76 of the arms 70 are connected to the housing 12 over the combustion product discharge openings 28 which, in turn, are connected to the opposing ends of the combustion product exhaust manifold 46.

The fresh air intake assembly 30 includes a housing 80, a fan 82 and electrical motor. The air intake assembly housing has an air intake opening 84 in one side thereof and an outlet opening discharging into the space or plenum chamber defined between the bottom of housing 12 and the lower end of the heat exchanger assembly from whence the fresh air passes upwardly between the flues via the above noted passages 42 with the heated air ultimately being discharged via discharge opening 26 and discharge duct 32. Any suitable commercially available fan unit and motor may be used to provide the required fresh air flow volume.

The burner and combustion air intake assembly includes a housing 86 in which is mounted a fan 88 and electrical motor and a burner 90. Any suitable commercially available fan unit and motor may be used to provide the required combustion air flow. For safety reasons, among others, the pressure in the fresh air passages 42 is kept higher than in the combustion air passages 44 to avoid any leakage of combustion gases into the fresh air being heated. Typically the fresh air fan 82 will have a capacity several times that of the combustion air fan 88. The burner may be of the type manufactured by Haul-All Sureflame in Lethbridge, Canada although many other burners having the required capacity can be used. Generally, the burner is V-shaped and formed with a plurality of nozzles in the arms of the burner and which provide flames directed inwardly of the arms and into the firebox 20.

There has been described a furnace construction generally capable of satisfying the several objectives set out previously. The invention is not to be limited by the specific embodiment described but is to extend to the full range of equivalencies encompassed by the appended claims.

The embodiments of the invention in which an exclusive property of privilege is claimed are defined as follows:

1. A furnace comprising:

a housing having a top, a bottom and sides defining a firebox chamber and a heat exchange chamber, a fresh air intake opening adjacent said bottom, a heated fresh air discharge opening adjacent said top, a combustion air inlet opening adjacent said top, and a combustion product discharge opening adjacent said bottom;

a burner assembly secured to said housing for delivering heated air to said combustion air inlet opening;

a firebox mounted in said firebox chamber having an opening communicating with said combustion air inlet opening;

a modular, counterflow heat exchanger mounted in said heat exchange chamber and secured to the underside of said firebox and defining a plurality of alternating combustion product downflow channels and fresh air upflow channels, said channels being defined by a plurality of relatively thin-walled flue members each having:

an elongated slot-like combustion product inlet opening at one end thereof, a combustion product discharge opening in said member adjacent the other end thereof, flange means extending laterally from each side of said slot-like intake opening for securing adjacent flue members together in predetermined spaced relation so at to define said upflow channels therebetween, spacer means at the other end of said flue members for securing adjacent flue members together in said predetermined spaced relation to permit entrance of the fresh air therebetween into said up flow channels from the fresh air intake opening, the upper ends of said upflow channels communicating with said heated air discharge opening.

2. The furnace of claim 1 wherein said flue members comprise sheet metal panels corrugated to provide serpentine upflow and downflow said channels.

3. A furnace comprising:

a generally rectangular housing having a top wall, a bottom wall and four side walls defining a heat exchange chamber, a fresh air intake opening in one of said side walls adjacent said bottom wall, a heated fresh air discharge opening in said one side wall adjacent said top wall, a combustion air intake opening in a side wall opposite said one of said side walls and adjacent said top wall, a combustion product discharge opening in each of the other two of said side walls adjacent said bottom wall;

a heater intake duct secured to said housing for delivering heated air to said combustion air intake opening;

a burner mounted in and secured to said heater intake duct for receiving and heating ambient air;

a generally inverted U-shaped combustion product discharge duct secured to said housing and having one end connect to each said combustion product discharge opening, said discharge ducts extending from said openings adjacent said other side walls and merging into a single duct above and adjacent said top wall.

4. The furnace of claim 3 including a counterflow heat exchanger within said chamber, said heat exchanger comprising a plurality of spaced apart, transversely corrugated wall members.

* * * * *